US006053403A

United States Patent [19]

Cai

[11] Patent Number: 6,053,403

[45] Date of Patent: Apr. 25, 2000

[54] CONICAL FOOD SCOOP

[75] Inventor: Liming Cai, West Chester, Pa.

[73] Assignee: Dopaco, Inc., Exton, Pa.

[21] Appl. No.: 09/154,985

[22] Filed: Sep. 17, 1998

[51] Int. Cl.[7] ..... B65D 3/28

[52] U.S. Cl. ..... 229/400; 229/4.5; 229/104

[58] Field of Search ..... 229/4.5, 104, 193, 229/400, 405

[56] References Cited

U.S. PATENT DOCUMENTS

| | | | |
|---|---|---|---|
| 677,017 | 6/1901 | Carrington | 229/4.5 |
| 2,112,959 | 4/1938 | Harvey | 229/4.5 |
| 2,385,898 | 10/1945 | Waters | 229/400 |
| 2,761,448 | 9/1956 | Monroe | 229/400 |
| 3,580,473 | 5/1971 | Gill | 229/104 |
| 3,630,430 | 12/1971 | Struble . | |
| 4,020,988 | 5/1977 | Kipp . | |
| 4,185,764 | 1/1980 | Cote . | |
| 4,252,264 | 2/1981 | Herbst et al. | 229/4.5 |
| 4,267,955 | 5/1981 | Struble . | |
| 4,502,623 | 3/1985 | Moore, Jr. et al. . | |
| 4,552,293 | 11/1985 | Blagg et al. | 229/4.5 |
| 4,718,595 | 1/1988 | Jones . | |
| 4,915,235 | 4/1990 | Roosa | 229/400 |
| 5,301,870 | 4/1994 | Smith et al. . | |
| 5,720,429 | 2/1998 | Cordle . | |

*Primary Examiner*—Gary E. Elkins
*Attorney, Agent, or Firm*—Dennison, Scheiner, Schultz & Wakeman

[57] ABSTRACT

A french fry scoop of a slightly tapering truncated conical configuration with a curvilinear upper edge including a low concave front panel upper edge and a substantially higher convex rear panel upper edge. The scoop includes an integral bottom formed along fold lines.

21 Claims, 2 Drawing Sheets

CONICAL FOOD SCOOP

BACKGROUND OF THE INVENTION

Food scoops of the type normally referred to as french fry scoops are widely used as containers, particularly in "fast food" establishments, for the dispensing of french fries, onion rings, chicken nuggets and like "finger" foods.

Such known scoops are of a generally rectangular configuration with a higher back wall providing for or assisting in the scooping of the fries therein.

With the conventional scoop, the container, when filled, will normally lie flat on its back panel with the contents tending to spill from the open mouth thereof, unless the scoop is held upright in the consumer's hand or is otherwise physically maintained in a vertical position as by being wedged in a serving tray by adjacent products. The actual holding of the scoop can be awkward because of the elongate rectangular configuration.

The conventional scoop also incorporates multiple vertically extending fold lines defining distinct planar sides to the scoop which do not particularly lend themselves to a continuous surface pattern about the peripheral wall of the scoop. Problems may also arise with regard to the proper filling of the conventional scoop, and the withdrawal of the fries or the like therefrom in light of the relatively narrow elongate nature of the scoop and the angular corners provided about the interior thereof.

Attempts have been made to improve on the conventional fry scoop in various ways, including increasing the curvature of the front and rear walls, particularly toward the upper portion of the scoop, and forming the lower portion into a cross-sectional configuration which more closely approaches a square rather than an elongate rectangle with fold lines defining the lower generally square configuration of the scoop and the opposed sides of the scoop being substantially planar for at least a portion of the height thereof upward from the bottom. However, the use of fold lines in the wall panels inherently causes an interruption in any surface patterns or indicia. Further, while a square bottom may provide more stability for a self-standing scoop, there is much room for improvement. In this regard, a square bottom does not particularly lend itself to formation from a single blank, and problems in attempting to provide a wrinkle-free base are substantial.

SUMMARY OF THE INVENTION

The present invention significantly improves over the conventional scoop or suggested variations thereof by providing a scoop which is capable of independently standing upright in a particularly stable manner, and which is particularly adapted to nest within conventional cup holders in the same manner as a conventional drink cup. It is also a particularly significant object of the invention to provide a scoop wherein the peripheral exterior of the scoop, for the full height thereof, is devoid of fold lines and presents a continuous generally cylindrical or conical surface for enhanced display of surface indicia, ease of handling, enhanced food capacity, and the like. In conjunction therewith, while generally the same forming techniques will be used, it is contemplated there will be a reduction in the amount of material required for a comparable volume. Further, as no fold lines are required in the formation of the peripheral wall, the forming and folding of the blank should be simplified.

Basically, the scoop of the invention is formed with a generally cylindrical, or more particularly an inverted slightly truncated configuration with an open upwardly directed mouth and a closed bottom. The mouth is defined by a curvilinear upper edge having a first forward or front extent of an upward concave shape and a rear or back extent of an upward convex shape with the opposed extents meeting at the opposed sides of the wall whereat vertical joinder seams are provided between the curved front and rear wall panels. The external surface of the scoop is continuous and circular in cross-section, interrupted only by the opposed overlapping glued seams, allowing for an uninterrupted presentation of surface indicia. The formed scoop, in light of the generally cylindrical configuration, particularly of the lower portion thereof, uniquely lends itself for engagement within cup containers for a hands-free presentation of the scoop in the manner of a conventional drink cup. Similarly, the substantially circular base of the scoop in conjunction with a recessed bottom or bottom panel, regardless of whether the bottom is upwardly or downwardly folded relative to the interior of the scoop, provides for a free self supporting positioning of the scoop. This accommodation of different positions of the bottom is achieved by the provision of distinct arcuate support feet which provide a support base below the bottom panel.

The blank from which the scoop is formed includes a central bottom panel which can broadly be considered of slightly elongate circular configuration, and opposed front and rear wall panels aligned with the long axis of the bottom panel and extending outward therefrom. The panels have base edges laterally extending from the bottom panel and outwardly extending side edges at substantially equal angles to the base edges with one panel terminating in an outer edge which is concave for the full extent thereof, and the second relatively longer panel terminating in a convex outer edge which is convex for the full extent thereof.

The bottom panel, integral with the front and rear wall panels, forms the bottom of the cup-like lower portion of the scoop during the formation of the scoop and avoids the necessity of providing a separate member seamed to the lower edge of the peripheral wall. As the bottom panel will have to conform to the generally cylindrical forming of the wall panels, it is considered particularly significant that preformed fold lines, preferably of opposed arcs or an "x" arrangement, be provided in the bottom panel of the blank to relieve stress during folding, and ensure a proper upward folding of the bottom panel without wrinkling or otherwise causing an unattractive and possibly weakened bottom.

Other features and details of the scoop will become apparent from the more detailed description of the invention as follows.

DESCRIPTION OF PREFERRED EMBODIMENTS

The scoop 10 includes a vertical wall 12 of generally cylindrical and preferably slightly conical configuration increasing in circular diameter from a lower edge 14 to an enlarged curvilinear and generally inclined peripheral upper edge 16.

Figure 5:
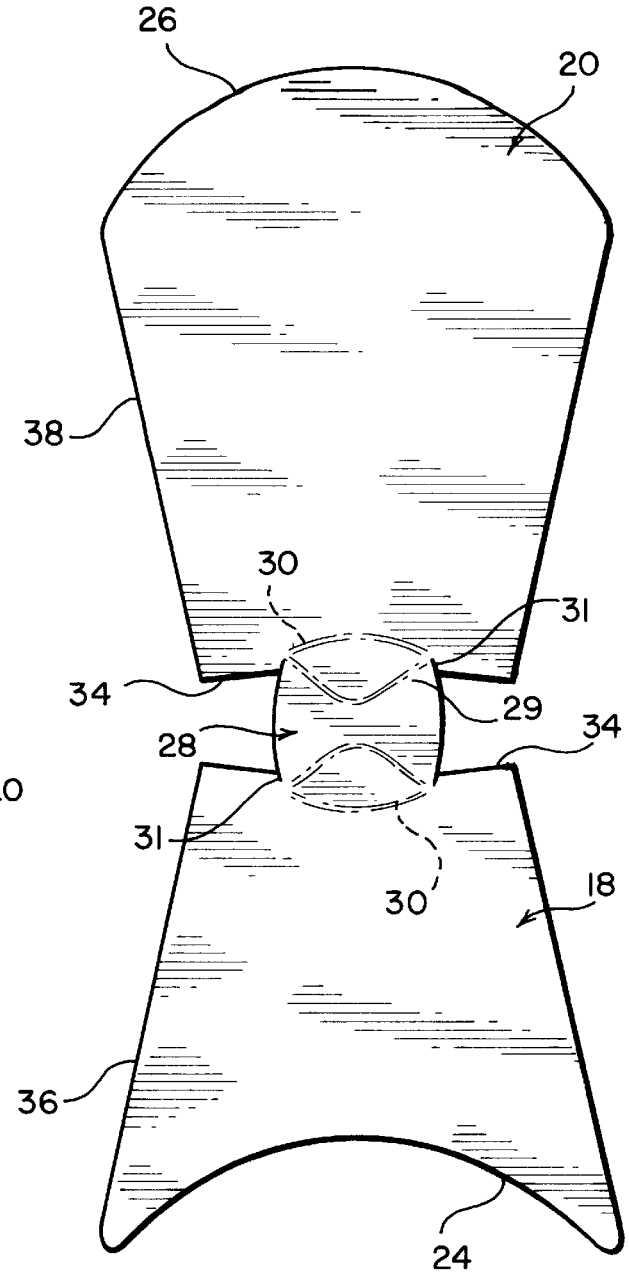
FIG. 5 is a plan view of the blank from which the scoop is folded, with another preferred form of bottom panel fold lines illustrated.

The wall 12, also noting the blank of FIG. 5, is defined by front and rear wall panels 18 and 20 inwardly rolled toward each other into semi-cylinders with overlapping edge portions adhesively bonded to form opposed side seams 22. These side seams 22 constitute the only interruptions in the otherwise smooth uninterrupted conical or cylindrical surface of the scoop 10, with the scoop providing, in effect, a cup-like configuration and a surface which is particularly adapted for presenting indicia continuously about the periphery thereof. There are no surface interrupting vertical fold lines or vertical angles formed thereby, and substantially circular cross-sections are maintained throughout the height of the scoop 10.

The upper edge 16 of the scoop wall 12 includes a forward extent 24, formed along the upper edge of the front wall panel 18, which is concave between the edges defining the seams 22. A similar rear extent 26 of the upper edge 16 is convex and defined by the upper edge of the rear panel 20 between the seam-defining edges thereof whereat the rear panel 20 is joined to the front panel 18. The arcs of both the front panel extent 24 and the rear panel extent 26 are substantially the same and, in the areas of the seams 22, provide for a smooth transition between concave and convex curvatures, providing for a substantially greater height to the rear or "scoop" portion of the wall 12 and a continuous sloping of this top edge 16 from a high point at the center of the convex extent 26 to a low point at the center of the concave extent 24.

The scoop 10 includes a bottom 28 of generally elongate circular configuration and integrally formed with and extending between the wall panels 18 and 20 slightly inward of the lower edge portions of the wall panels. The opposed longitudinally spaced arcuate edge portions of the bottom 28, indicated by fold lines 30 in the blank of FIG. 5, produce a slight transverse, preferably upward, curvature to the bottom 28 in the erected scoop 10 and thus enhance the rigidity of the bottom 28 and the wall 12 of the scoop. It is significant that specific fold lines 29 be provided in the bottom 28 as the blank is produced to facilitate the upward arcing thereof as the scoop is formed from the blank. It has also been found that the fold lines 29, to ensure a proper folding of the bottom panel as the scoop is erected, and to avoid any wrinkling or otherwise distorting of the bottom panel, must originate in the corners of the bottom defined by the opposed ends of the bottom defining fold lines 30 as in the illustrated examples. No separate bottom panel insert or the like is required.

Figure 2:
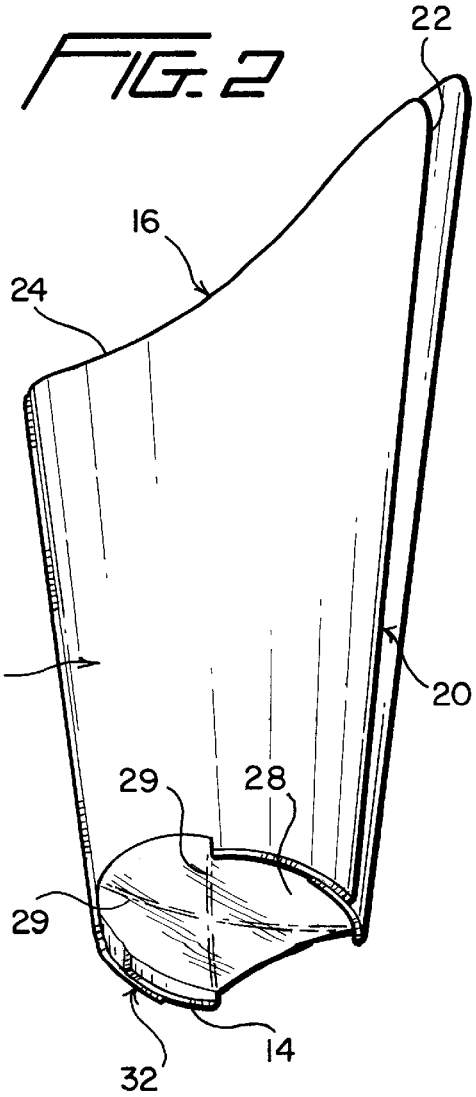
FIG. 2 is a bottom perspective view of the scoop.
Figure 3:
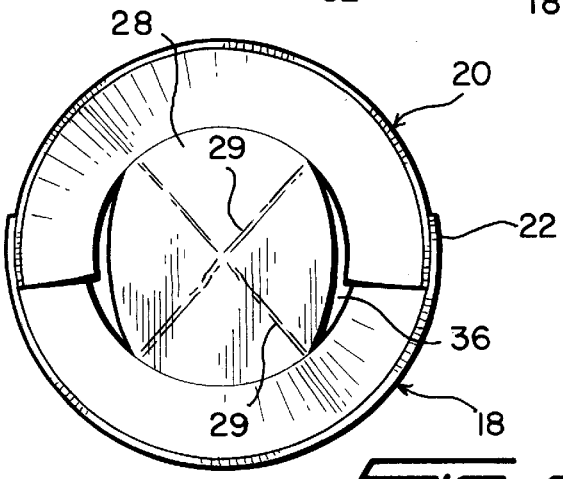
FIG. 3 is a top plan view of the scoop.
Figure 4:
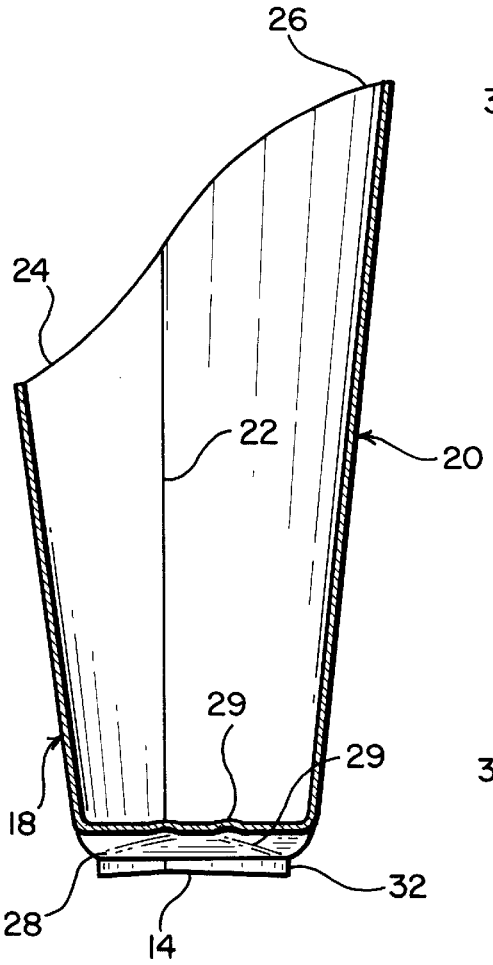
FIG. 4 is a vertical section through the scoop.

The fold lines 29 in the bottom panel, preferably of an "x" configuration as in FIGS. 2 and 3 or opposed arcs as suggested in FIGS. 4 and 5, are particularly significant in ensuring a controlled upward forming of the bottom panel 28 in conjunction with the transverse arcing of the front and rear panels 18 and 20. This upward folding of the bottom 28 is, in the manufacturing procedure, normally achieved by the use of a suction member which, as the lower panels are arced, produces an upward lift on the bottom panel. In the absence of such fold lines 29, there would be a substantial tendency for the bottom panel to wrinkle and randomly fold in a manner which would weaken the lower portion of the scoop and produce an unattractive appearance, the appearance of the container being of significance in directly dealing with the public.

The preforming of the fold controlling or guiding lines 29 is also significant in accommodating any slight irregularities in the blank which might affect the optimum alignment of the two semi-cylindrical wall panels and which, while not noticeable in the finished product, could cause problems in the formation of the bottom without the fold controlling lines 29.

Another particular advantage of the specific fold lines 29 is to accommodate those instances wherein, because of design preferences, manufacturing tolerances, slight misalignments, or the like, the bottom panel 28 does not upwardly fold, but rather, flexes downward. Again, with no controlling fold lines 29, the downwardly flexed bottom panel would be formed with random wrinkles and a resultant appearance which would not be particularly acceptable either to the dispenser of the foodstuffs or the purchaser. However, with the controlling fold lines, particularly the "x" configuration of FIG. 3 and the opposed arcs of FIG. 5, any downward forming of the bottom panel, as opposed to the preferred upward folding, would produce a clearly defined bottom of specific angularly related panels which provide a finished appearance to the bottom slightly recessed relative to opposed arcuate foot sections 32. In either situation, a finished appearance is provided and, by providing for the controlled forming of the bottom, any stresses therein, as might wrinkle the bottom or disform the lower portion of the scoop, are relieved.

Figure 1:
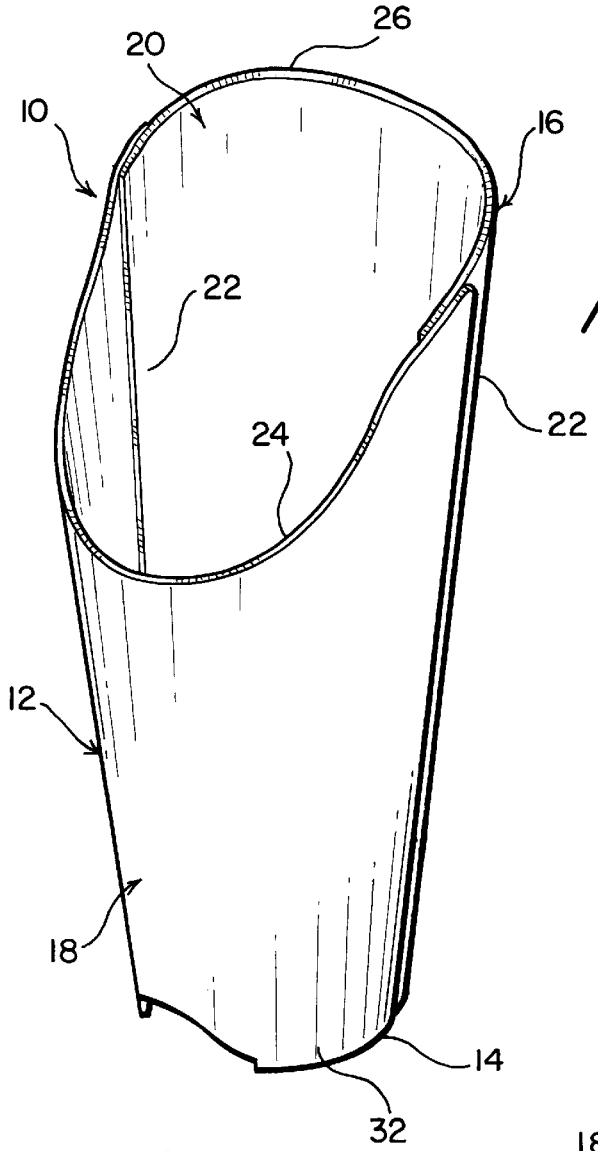
FIG. 1 is top perspective view of the scoop of the invention.

The fold lines 30 which define the bottom 28 are slightly inwardly offset from the lower edges of the wall panels 18 and 20 and extend between the inner ends of slits 31 which continue the arcs of the opposed longer sides of the bottom. By forming the bottom 28 in this manner, and as will be appreciated from FIGS. 1 and 2, the lower portion of the scoop 10 has the opposed arcuate foot sections 32 formed to and slightly outward of the opposite arcuate sides of the bottom 28. The foot sections 32 extend below the bottom to provide elongate front-to-rear support feet for the scoop, each foot section being centrally positioned with regard to a corresponding side seam 22. Each of the foot sections 32 is slightly upwardly offset centrally thereof whereby the lower support edge actually makes contact with a support surface only at the outer tips thereof, thus providing a more stable engagement with a table surface or the like, particularly should there be any irregularities in the surface. Such an edge configuration is provided for in the blank by extending the base edge end portions 34 of each of the front and rear wall panels 18 and 20, laterally outward from the bottom panel 28, at a slight outward angle toward the opposed base edges.

With continued reference to the blank of FIG. 5, it will be noted that the widths of both wall panels 18 and 20 at the base edge are substantially equal, as are the angles of the outwardly extending side edges 36 of panel 18 and side edges 38 of panel 20 which, in the formed scoop 10, define the side seams 22. The panels 18 and 20, in the blank, are planar and without fold lines. The only fold lines, other than those used to shape the bottom 28, are fold lines 30 between bottom 28 and the lower edge portions of the wall panels 18 and 20.

While the lower portion of the formed scoop is circular in cross-section, it is significant to note that the bottom 28 and the panel in the blank from which the bottom is formed are of an elongate circular configuration rather than a perfect circle in that a circular bottom panel of equal diameter with the lower portion of the scoop will not properly form into a scoop bottom without substantial disruptive wrinkling, even if fold guiding lines are provided. Further, any attempt to avoid this problem by providing that the opposed longitudinal edges of the bottom panel be straight will result in a rather large and generally impractical gap between the opposed straight edges and the circular scoop wall at the lower end thereof. While this might be acceptable for large food products, with smaller or thinner food products, such as shoestring french fries and the like, such products can easily fall through the gaps.

In avoiding these problems, the bottom 28 is elongate, along the longitudinal axis in the blank, and specifically includes opposed arcuate side edges which both avoid possible disruptive contact with the corresponding opposed arcuate portions of the formed scoop wall, and at the same time minimize the gap 36 provided therebetween, note FIG. 3. Basically, the arcs of fold lines 30 are on equal radii with a center at or close to the center point of the bottom panel. The arcs of the side edges of the bottom panel are on equal radii greater than the first radii.

From the foregoing, it will be appreciated that a unique french fry scoop has been defined which, both structurally and functionally, constitutes a significant advance in the art. As variations, within the scope of the claims appearing hereinafter, may occur to those skilled in the art, it is not intended to limit the invention to the specific embodiments illustrated.

I claim:

1. A food scoop comprising a vertically elongate generally cylindrical wall, said wall having an upper peripheral edge forming an upwardly opening mouth, and a lower peripheral edge with a bottom joined thereto, said upper edge being continuously curvilinear and having a first extent of a downwardly concave configuration and a second opposed extent of upwardly convex configuration positioned higher relative to said first extent, wherein said first concave extent and said second convex extent meet at two substantially opposed areas on said upper peripheral edge.

2. The scoop of claim 1 wherein said wall is of a predetermined circular cross-section adjacent said lower edge and of a progressively increasing circular cross-section upward therefrom to said upper edge.

3. The scoop of claim 2 wherein said wall includes a front wall panel with opposed vertical edges and an upper concave edge extending to and between said vertical edges of said front wall panel and defining said first extent, and a rear wall panel with opposed vertical edges and an upper convex edge extending to and between said vertical edges of said rear wall panel and defining said convex extent, said opposed edges of said rear wall panel being bonded to said opposed edges of said front wall panel.

4. The scoop of claim 3 wherein said bottom is integrally formed with said front and rear wall panels inwardly spaced from said bonded opposed vertical edges of said front and rear wall panels.

5. The scoop of claim 1 wherein said wall is of a predetermined circular cross-section adjacent said lower edge and of a progressively increasing circular cross-section upward therefrom to said upper edge.

6. A food scoop comprising a vertically elongate generally cylindrical wall, said wall having an upper peripheral edge forming an upwardly opening mouth, and a lower peripheral edge with a bottom joined thereto, said upper edge being continuously curvilinear and having a first extent of a downwardly concave configuration and a second opposed extent of upwardly convex configuration positioned higher relative to said first extent, wherein said wall includes a front wall panel with opposed vertical edges and an upper concave edge extending to and between said vertical edges of said front wall panel and defining said first extent, and a rear wall panel with opposed vertical edges and an upper convex edge extending to and between said vertical edges of said rear wall panel and defining said convex extent, said opposed edges of said rear wall panel being bonded to said opposed edges of said front wall panel.

7. The scoop of claim 6 wherein said bottom is integrally formed with said front and rear wall panels inwardly spaced from said bonded opposed vertical edges of said front and rear wall panels.

8. For use in the formation of a food scoop of an inverted, truncated conical configuration; a unitary blank, said blank comprising opposed front and rear wall panels aligned along a longitudinal axis of said blank, said panels having spaced facing base edges, a bottom panel integral with each of said front and rear wall panels at said base edges and extending therebetween, said bottom panel being elongate along said longitudinal axis and having a first opposed pair of longitudinally spaced arcuate edges and a second pair of laterally spaced arcuate end side edges, said arcuate end edges being of a predetermined radius and being defined in said opposed wall panels in inwardly spaced relation to the corresponding base edges thereof, said arcuate side edges of said bottom panel being on a greater radius than said predetermined radius and continuing through said opposed wall panels to define opposed corners with said end edges, said opposed wall panels having slits extending inward relative to said base edges and aligned with said bottom panel side edges to accommodate extension of said side edges to said end edges, the base edge of each panel extending laterally beyond said bottom panel to form a pair of opposed base edge end portions, said front and rear wall panels each having an outer edge in spaced opposed relation to the corresponding base edge, said front and rear wall panels each having opposed side edges extending between the corresponding base edge and outer edge, said outer edge of said front panel being concave, said outer edge of said rear panel being convex.

9. The structure of claim 8 wherein said base edge and said outer edge of each of said front and rear panels terminate in outer ends, said opposed side edges of each of said wall panels extending between the outer ends of the corresponding base edge and outer edge.

10. The structure of claim 9 wherein the concave outer edge of said front panel is concave for the full extent of the outer edge between the ends thereof, said convex outer edge of said rear panel being convex along the full extent thereof between the outer ends thereof.

11. The structure of claim 10 wherein said opposed side edges of each of said front and rear wall panels diverge outwardly from each other from the corresponding base edge to the corresponding outer edge to define a generally truncated triangular configuration for each wall panel.

12. The structure of claim 11 wherein said base edges of said front and rear panels are of equal length.

13. The structure of claim 12 wherein the end portions of the base edges to each side of said bottom panel converge outwardly to the corresponding side edges of said wall panels.

14. The structure of claim 8 wherein said base edges of said front and rear panels are of equal length.

15. The structure of claim 14 wherein the end portions of the base edges to each side of said bottom panel converge outwardly to the corresponding side edges of said wall panels.

16. The structure of claim 9 including fold lines defined in said bottom panel and extending inward from opposed corners of said bottom panel and generally diagonally in said bottom panel.

17. The structure of claim 16 wherein two of said fold lines are formed in said bottom panel, said two fold lines each being of a generally arcuate configuration extending between two of the corners of the bottom panel within a single wall panel.

18. The structure of claim 16 wherein said score lines in said bottom panel comprise two score lines, each extending diametrically across said bottom panel between diametrically opposed corners with said score lines crossing centrally within said bottom panel.

19. A food scoop comprising a vertically elongate peripheral wall, said wall having an upper peripheral edge forming an upwardly opening mouth, and a lower peripheral edge with a bottom joined thereto, said wall being of a predetermined diameter adjacent said lower edge and of a progressively increasing diameter upward therefrom to said upper edge, said wall including a front wall panel with opposed vertical edges and a rear wall panel with opposed vertical edges, said opposed edges of said rear wall panel being bonded to said opposed edges of said front wall panel, said bottom being integrally formed with said front and rear wall panels along arcuate fold lines defining end edges of said bottom, said bottom having opposed arcuate side edges inwardly spaced form said bonded opposed vertical edges of said front and rear wall panels.

20. The scoop of claim 17 wherein said lower peripheral edge of said wall, laterally outward of the opposed arcuate side edges of said bottom, depend below said bottom and defines arcuate support feet for said scoop independently of said bottom.

21. The scoop of claim 20 wherein said bottom end edges and side edges define two pairs of diametrically opposed corners, and guiding fold lines formed in said bottom, said guiding fold lines extending generally diametrically inward from said corners wherein said bottom is laterally offset in a vertical direction solely along said guiding fold lines.

* * * * *

UNITED STATES PATENT AND TRADEMARK OFFICE

CERTIFICATE OF CORRECTION

PATENT NO. : 6,053,403
APPLICATION NO. : 09/154985
DATED : April 25, 2000
INVENTOR(S) : Liming Cai It is certified that error appears in the above-identified patent and that said Letters Patent is hereby corrected as shown below:

In Claim 19, column 8, line 1, “form” should be changed to --from--.

Signed and Sealed this
Seventeenth Day of May, 2011

David J. Kappos

David J. Kappos
*Director of the United States Patent and Trademark Office*

US006053403C1

(12) EX PARTE REEXAMINATION CERTIFICATE (9288th)

United States Patent
Cai

(10) Number: US 6,053,403 C1
(45) Certificate Issued: Sep. 11, 2012

(54) CONICAL FOOD SCOOP

(75) Inventor: Liming Cai, West Chester, PA (US)
(73) Assignee: The Bank of New York Mellon, Atlanta, GA (US)

Reexamination Request:
No. 90/012,166, Feb. 29, 2012

Reexamination Certificate for:

| | |
|---|---|
| Patent No.: | **6,053,403** |
| Issued: | **Apr. 25, 2000** |
| Appl. No.: | **09/154,985** |
| Filed: | **Sep. 17, 1998** |

Certificate of Correction issued May 17, 2011.

(51) Int. Cl.
*B65D 3/28* (2006.01)

(52) U.S. Cl. ..... 229/400; 229/4.5; 229/104

(58) Field of Classification Search ..... None
See application file for complete search history.

(56) References Cited

To view the complete listing of prior art documents cited during the proceeding for Reexamination Control Number 90/012,166, please refer to the USPTO's public Patent Application Information Retrieval (PAIR) system under the Display References tab.

*Primary Examiner*—Jimmy G Foster

(57) ABSTRACT

A french fry scoop of a slightly tapering truncated conical configuration with a curvilinear upper edge including a low concave front panel upper edge and a substantially higher convex rear panel upper edge. The scoop includes an integral bottom formed along fold lines.

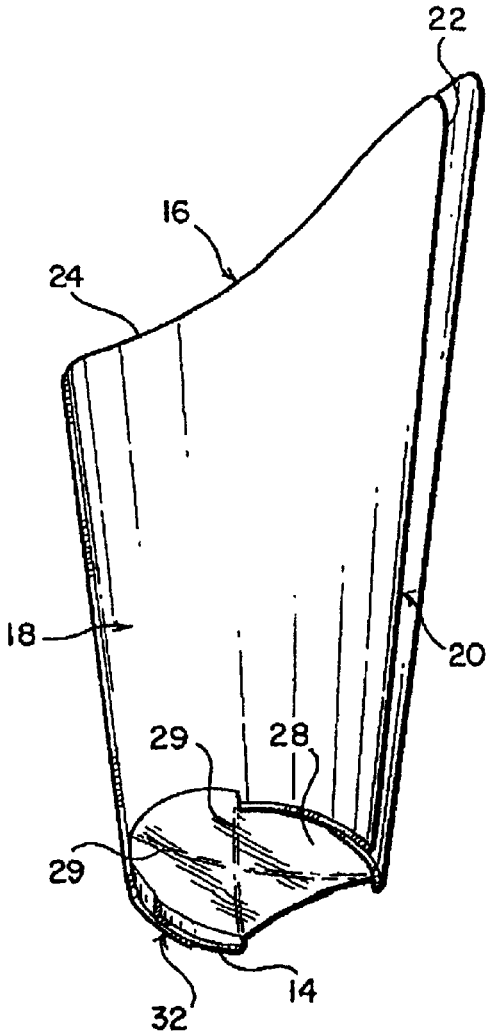

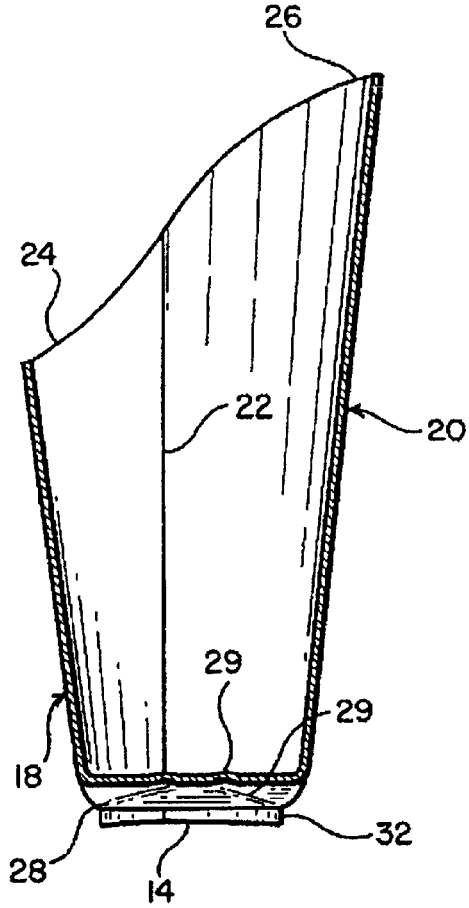

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 6-15 and 19 is confirmed.

Claims 1, 2 and 5 are cancelled.

Claim 3 is determined to be patentable as amended.

Claim 4, dependent on an amended claim, is determined to be patentable.

Claims 16-18, 20 and 21 were not reexamined.

3. [The scoop of claim 2] *A food scoop comprising a vertically elongate generally cylindrical wall, said wall having an upper peripheral edge forming an upwardly opening mouth, and a lower peripheral edge with a bottom joined thereto, said upper edge being continuously curvilinear and having a first extent of a downwardly concave configuration and a second opposed extent of upwardly convex configuration positioned higher relative to said first extent, wherein said first concave extent and said second convex extent meet at two substanially opposed areas on said upper peripheral edge, wherein said wall is of a predetermined circular cross-section adjacent said lower edge and of a progressively increasing circular cross-section upward therefrom to said upper edge, and* wherein said wall includes a front wall panel with opposed vertical edges and an upper concave edge extending to and between said vertical edges of said front wall panel and defining said first extent, and a rear wall panel with opposed vertical edges and an upper convex edge extending to and between said vertical edges of said rear wall panel and defining said convex extent, said opposed edges of said rear wall panel being bonded to said opposed edges of said front wall panel.

* * * * *